US011382187B2

(12) United States Patent
Sadahira et al.

(10) Patent No.: US 11,382,187 B2
(45) Date of Patent: Jul. 5, 2022

(54) ELECTROMAGNETIC FIELD DISTRIBUTION ADJUSTMENT DEVICE AND MICROWAVE HEATING DEVICE

(71) Applicant: Panasonic Corporation, Osaka (JP)

(72) Inventors: Masafumi Sadahira, Shiga (JP); Koji Yoshino, Shiga (JP); Masayuki Kubo, Shiga (JP); Osamu Hashimoto, Tokyo (JP); Ryosuke Suga, Kanagawa (JP)

(73) Assignee: PANASONIC HOLDINGS CORPORATION, Osaka (JP)

( * ) Notice: Subject to any disclaimer, the term of this patent is extended or adjusted under 35 U.S.C. 154(b) by 474 days.

(21) Appl. No.: 16/472,959

(22) PCT Filed: Dec. 25, 2017

(86) PCT No.: PCT/JP2017/046288
§ 371 (c)(1),
(2) Date: Jun. 24, 2019

(87) PCT Pub. No.: WO2018/131441
PCT Pub. Date: Jul. 19, 2018

(65) Prior Publication Data

US 2019/0373686 A1 Dec. 5, 2019

(30) Foreign Application Priority Data

Jan. 10, 2017 (JP) ..... JP2017-001553

(51) Int. Cl.
*H05B 6/64* (2006.01)
*H05B 6/74* (2006.01)

(52) U.S. Cl.
CPC ..... *H05B 6/6408* (2013.01); *H05B 6/6402* (2013.01); *H05B 6/74* (2013.01); *H05B 6/6414* (2013.01)

(58) Field of Classification Search
CPC .. H05B 6/6402; H05B 6/6408; H05B 6/6414; H05B 6/705; H05B 6/74; Y02B 40/00
(Continued)

(56) References Cited

U.S. PATENT DOCUMENTS

2013/0048880 A1* 2/2013 Einziger ..... H05B 6/686 250/492.1

FOREIGN PATENT DOCUMENTS

| | | |
|---|---|---|
| JP | 53-092939 | 8/1978 |
| JP | 58-005842 Y | 2/1983 |
| WO | 2015/133081 | 9/2015 |

OTHER PUBLICATIONS

International Search Report of PCT application No. PCT/JP2017/046288 dated Mar. 20, 2018.

* cited by examiner

*Primary Examiner* — Quang T Van
(74) *Attorney, Agent, or Firm* — Wenderoth, Lind & Ponack, L.L.P.

(57) ABSTRACT

A microwave heating device includes a heating chamber that accommodates an object to be heated, a microwave generator configured to generate microwaves, a wave guide tube configured to guide the microwaves to the heating chamber, and an electromagnetic field distribution adjustment device provided in a predetermined two-dimensional region within the heating chamber. The electromagnetic field distribution adjustment device has a plurality of metal pieces and a plurality of switches. The plurality of metal pieces are arranged to fill the predetermined two-dimensional region. The plurality of switches connect the plurality of metal pieces with one another. A serially connected row of metal pieces is configured by connecting one metal piece among the plurality of metal pieces to at most two metal pieces adjacent to the one metal piece through at least two of the
(Continued)

plurality of switches. The present exemplary embodiment can achieve a low-cost electromagnetic field distribution adjustment device that heats an object to be heated more uniformly, while preventing a drop in heating efficiency.

11 Claims, 10 Drawing Sheets

(58) Field of Classification Search
USPC ..... 219/678, 728, 729, 739, 732, 734, 738, 219/710, 702, 745, 747, 749, 756, 757, 219/762; 361/143, 146; 422/22, 105; 426/87, 103, 114, 234; 118/723 MW; 250/492.1
See application file for complete search history.

ELECTROMAGNETIC FIELD DISTRIBUTION ADJUSTMENT DEVICE AND MICROWAVE HEATING DEVICE

TECHNICAL FIELD

The present disclosure relates to an electromagnetic field distribution adjustment device and a microwave heating device including the same.

BACKGROUND ART

For microwave heating devices such as a microwave oven, it is desired to heat an object to be heated, which is accommodated in a heating chamber, uniformly without heating it unevenly. To achieve the above-mentioned aim, various configurations have been considered (e.g., see Patent Literatures 1 to 3).

Patent Literature 1 discloses a turn-table that rotates an object to be heated, which is placed on the turn-table. Patent Literature 2 discloses a rotating antenna configured to supply microwaves to a heating chamber while rotating the microwaves.

Patent Literature 3 discloses an electromagnetic field distribution adjustment device that has a plurality of metal pieces arranged in a matrix manner, and a plurality of switches each connecting two metal pieces adjacent to each other among the plurality of metal pieces. The electromagnetic field distribution adjustment device is configured to change impedance near the plurality of metal pieces.

CITATION LIST

Patent Literature

PTL 1: Japanese Examined Utility Model (Registration) Application Publication No. S58-005842

PTL 2: Japanese Unexamined Patent Publication No. S53-092939

PTL 3: International Publication 2015/133081

SUMMARY OF THE INVENTION

According to the invention described in Patent Literature 1, however, uneven heating occurs concentrically due to generation of standing waves in a heating chamber. According to the invention described in Patent Literature 2, heating intensity varies depending on a distance from an antenna, whereby uneven heating is occurred.

According to the invention described in Patent Literature 3, an electric power loss occurs when a switch is operated, thereby deteriorating heating efficiency. Moreover, in the invention described in Patent Literature 3, a large number of switches need to be wired physically and controlled simultaneously. Therefore, from the viewpoint of cost, it is not easy to apply the invention described in Patent Literature 3 to consumer appliances, such a microwave oven.

To solve the above-mentioned problem, the present disclosure aims to achieve a low-cost electromagnetic field distribution adjustment device that heats an object to be heated more uniformly while preventing a drop in heating efficiency.

An electromagnetic field distribution adjustment device in one aspect of the present disclosure includes: a plurality of metal pieces that are arranged to fill a predetermined two-dimensional region; a plurality of switches that connect the plurality of metal pieces with one another; and a serially connected row of metal pieces that includes a portion configured by connecting one metal piece among the plurality of metal pieces to at most two metal pieces adjacent to the one metal piece through at least two of the plurality of switches, the at most two metal pieces being included in the metal pieces.

According to the present aspect, there can be achieved a low-cost electromagnetic field distribution adjustment device that heats an object to be heated more uniformly while preventing a drop in heating efficiency.

DESCRIPTION OF EMBODIMENTS

Figure 1:
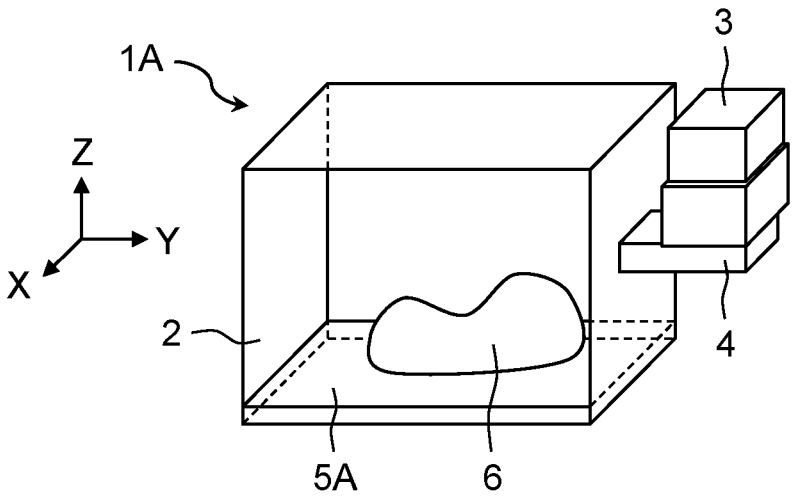
FIG. 1 is a perspective view of a microwave heating device including an electromagnetic field distribution adjustment device in accordance with a first exemplary embodiment of the present disclosure.

An electromagnetic field distribution adjustment device in a first aspect of the present disclosure includes: a plurality of metal pieces that are arranged to fill a predetermined two-dimensional region; a plurality of switches that connect the plurality of metal pieces with one another; and a serially connected row of metal pieces that includes a portion configured by connecting one metal piece among the plurality of metal pieces to at most two metal pieces adjacent to the one metal piece through at least two of the plurality of switches, the at most two metal pieces being included in the metal pieces.

According to the electromagnetic field distribution adjustment device in a second aspect of the present disclosure, in the first aspect, the plurality of metal pieces each have one side whose length is less than half of wavelength of a microwave.

In addition to the first aspect, the electromagnetic field distribution adjustment device in a third aspect of the present disclosure further includes a grounding conductor that is provided along the predetermined two-dimensional region, and a plurality of short-circuiting conductors that connect the plurality of metal pieces to the grounding conductor.

According to the electromagnetic field distribution adjustment device in a fourth aspect of the present disclosure, in the first aspect, the electromagnetic field distribution adjustment device has substantially infinite impedance near the plurality of metal pieces when the plurality of switches are opened, and has substantially zero impedance near the plurality of metal pieces when the plurality of switches are closed.

In addition to the first aspect, the electromagnetic field distribution adjustment device in a fifth aspect of the present disclosure further has a potential determination part that is configured to determine a potential of the serially connected row of metal pieces.

According to the electromagnetic field distribution adjustment device in accordance with a sixth aspect of the present disclosure, in the first aspect, the serially connected row of metal pieces is arranged in a part of the predetermined two-dimensional region.

A microwave heating device in a seventh aspect of the present disclosure includes: a heating chamber that accommodates an object to be heated; a microwave generator that is configured to generate microwaves; a wave guide tube that is configured to guide the microwaves to the heating chamber; and an electromagnetic field distribution adjustment device that is provided in a predetermined two-dimensional region within the heating chamber.

The electromagnetic field distribution adjustment device has a plurality of metal pieces and a plurality of switches. The plurality of metal pieces are arranged to fill the predetermined two-dimensional region. The plurality of switches connect the plurality of metal pieces with one another. A serially connected row of metal pieces is configured such that one metal piece among the plurality of metal pieces is connected to at most two metal pieces adjacent to the one metal piece through at least two of the plurality of switches.

According to the microwave heating device in an eighth aspect of the present disclosure, in the seventh aspect, the electromagnetic field distribution adjustment device is provided in at least one of wall faces within the heating chamber.

According to the microwave heating device in a ninth aspect of the present disclosure, in the eighth aspect, the electromagnetic field distribution adjustment device is partially provided in the at least one of wall faces.

According to the microwave heating device in a tenth aspect of the present disclosure, in the seventh aspect, the electromagnetic field distribution adjustment device is detachably provided in any of wall faces within the heating chambers.

According to the microwave heating device in an eleventh aspect of the present disclosure, in the seventh aspect, the electromagnetic field distribution adjustment device is provided near an opening of the wave guide tube.

Hereinafter, exemplary embodiments of the present disclosure will be described with reference to the drawings. In the following drawings, the same reference numerals are assigned to the same components, and redundant description thereof is omitted.

First Exemplary Embodiment

Figure 2:
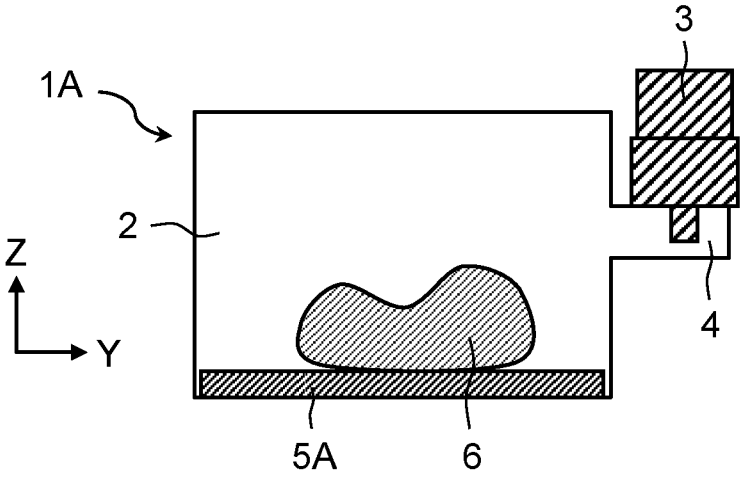
FIG. 2 is a longitudinal sectional view of the microwave heating device including the electromagnetic field distribution adjustment device in accordance with the first exemplary embodiment.

FIG. 1 and FIG. 2 are a perspective view and a longitudinal sectional view of microwave heating device 1A in accordance with a first exemplary embodiment of the present disclosure, respectively.

In the present exemplary embodiment, microwave heating device 1A is a microwave oven having heating chamber 2. In FIG. 1, a front wall of heating chamber 2 is omitted such that the inside of heating chamber 2 can be seen.

As shown in FIGS. 1 and 2, in addition to heating chamber 2, microwave heating device 1A includes microwave generator 3, wave guide tube 4, and electromagnetic field distribution adjustment device 5A. In the present disclosure, a back-and-forth direction, a horizontal direction, and a vertical direction of heating chamber 2 are defined as X-direction, Y-direction, and Z-direction, respectively.

In a front opening of heating chamber 2, a door (not shown) is provided, and object 6 to be heated is accommodated in an inner space of heating chamber 2.

Microwave generator 3 is constituted by a magnetron or the like, and generates a microwave. Wave guide tube 4 guides the microwave from microwave generator 3 to heating chamber 2. In the present exemplary embodiment, an opening of wave guide tube 4 is provided in a side wall of heating chamber 2.

Electromagnetic field distribution adjustment device 5A is provided in a predetermined two-dimensional region within heating chamber 2. Electromagnetic field distribution adjustment device 5A changes impedance on its face opposite to the inner space of heating chamber 2. Thus, electromagnetic field distribution adjustment device 5A changes an electromagnetic field distribution, i.e., a standing wave distribution in the vicinity thereof. As a result, the heating distribution of object 6 to be heated can be changed, so that uniform heating of object 6 to be heated can be achieved.

If object 6 to be heated is placed near electromagnetic field distribution adjustment device 5A, uniform heating effect will be obtained easily. In the present exemplary embodiment, the predetermined two-dimensional region corresponds to an entire bottom face of heating chamber 2.

In this case, object 6 to be heated is placed on electromagnetic field distribution adjustment device 5A.

Figure 3:
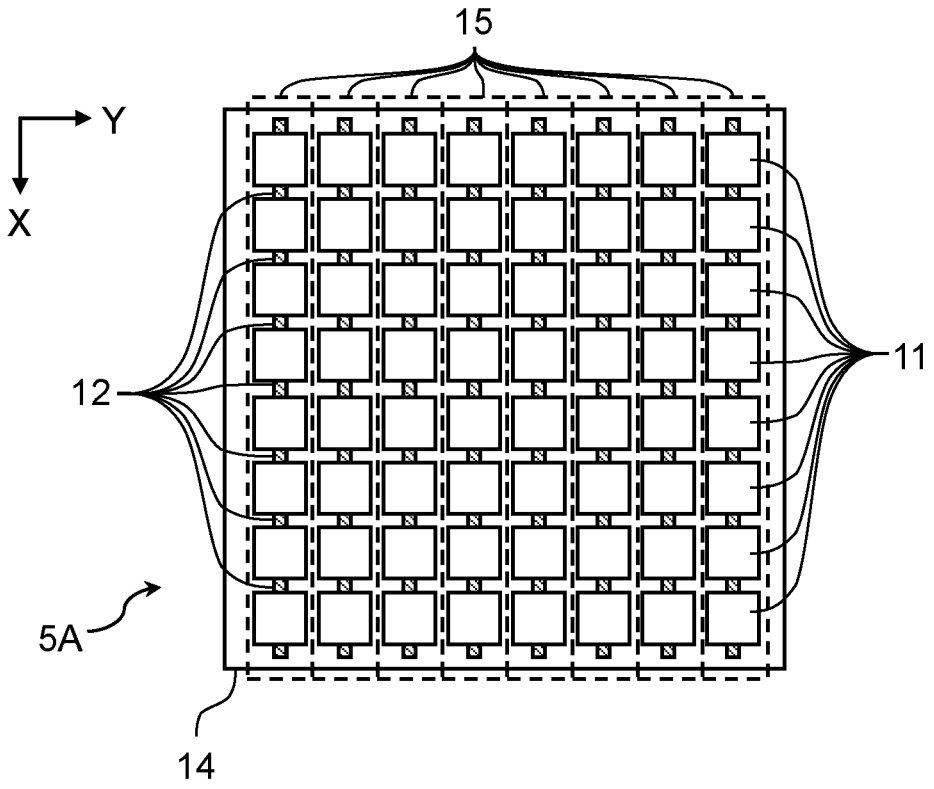
FIG. 3 is a top view of the electromagnetic field distribution adjustment device in accordance with the first exemplary embodiment.
Figure 4:
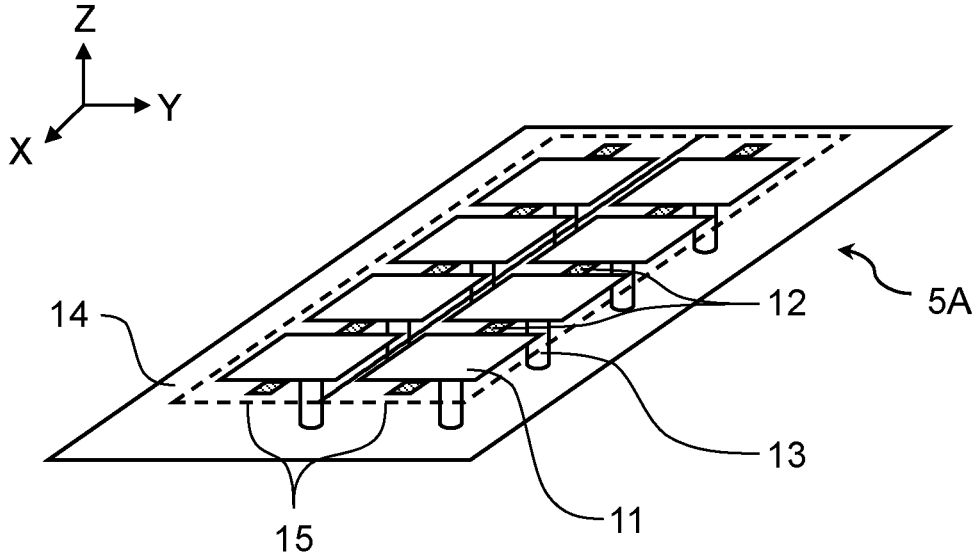
FIG. 4 is a perspective view of the electromagnetic field distribution adjustment device in accordance with the first exemplary embodiment.

FIG. 3 and FIG. 4 are a top view and a perspective view of electromagnetic field distribution adjustment device 5A, respectively. As shown in FIGS. 3 and 4, electromagnetic field distribution adjustment device 5A includes a plurality of metal pieces 11, a plurality of switches 12, a plurality of short-circuiting conductors 13, and grounding conductor 14.

Grounding conductor 14 is provided along the bottom face of heating chamber 2. Grounding conductor 14, which corresponds to a bottom face of electromagnetic field distribution adjustment device 5A, is an electrically grounded surface having a reference potential.

Switch 12 is provided between two metal pieces 11 adjacent to each other in a column direction (X-direction shown in FIGS. 3 and 4).

Electromagnetic field distribution adjustment device 5A has eight serially connected rows 15 of metal pieces arranged in a row direction (Y-direction shown in FIGS. 3 and 4). The plurality of metal pieces 11 are connected in series with one another through switches 12 provided therebetween to constitute serially connected row 15 of metal pieces.

In other words, serially connected row 15 of metal pieces includes a portion configured such that one metal piece 11 among the plurality of metal pieces 11 is connected to at most two metal pieces 11 adjacent to the one metal piece 11 through at least two of the plurality of switches 12.

Metal piece 11 is a square metal plate whose one side has a length less than half of wavelength of the microwave. The plurality of metal pieces 11 are arranged on a plane, which is in parallel to grounding conductor 14, in a matrix manner such that the plurality of metal pieces 11 are opposite to grounding conductor 14.

Short-circuiting conductor 13 connects metal piece 11 to grounding conductor 14. A combination of metal piece 11 and short-circuiting conductor 13 is referred to as a unit cell with a mushroom structure.

Dimensions such as length of one side of metal piece 11 and height of short-circuiting conductor 13 are designed such that, when switch 12 is opened, electromagnetic field distribution adjustment device 5A functions as a magnetic wall, with respect to the microwave.

Figure 5:
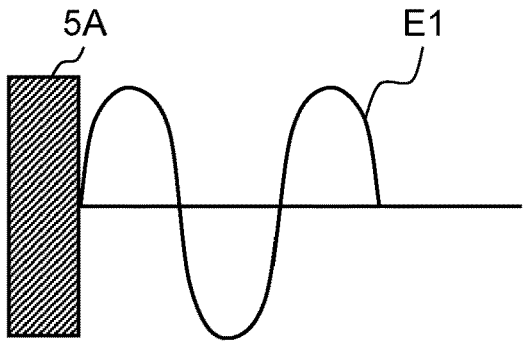
FIG. 5 is a view showing electric field distribution E1 near the electromagnetic field distribution adjustment device when a switch is closed.
Figure 6:
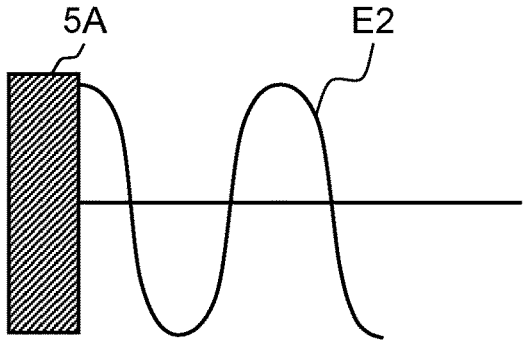
FIG. 6 is a view showing electric field distribution E2 near the electromagnetic field distribution adjustment device when the switch is opened.

FIG. 5 shows electric field distribution E1 near electromagnetic field distribution adjustment device 5A when switch 12 is closed. FIG. 6 shows electric field distribution E2 near electromagnetic field distribution adjustment device 5A when switch 12 is opened.

In serially connected row 15 of metal pieces, a plane including switch 12 and metal piece 11 functions as a conductor plate when switch 12 is closed. In this case, electromagnetic field distribution adjustment device 5A constitutes a short-circuit plane that has substantially zero impedance near the plurality of metal pieces 11.

As shown in FIG. 5, if electromagnetic waves are reflected on the short-circuit plane, a standing wave whose node lies on the short-circuit plane, i.e., surfaces of the plurality of metal pieces 11 will be formed.

Electromagnetic field distribution adjustment device 5A functions as an electric wall that has substantially zero impedance near the plurality of metal pieces 11.

When switch 12 is opened, electromagnetic field distribution adjustment device 5A constitutes a meta-material in which a large number of unit cells are arranged two-dimensionally and periodically. In this case, electromagnetic field distribution adjustment device 5A functions as a magnetic wall that has substantially infinite impedance near the plurality of metal pieces 11. Herein, the expression of "arranged two-dimensionally and periodically" means that a plurality of objects with the same structure are arranged at constant intervals in a longitudinal direction and a transverse direction.

Even if switch 12 is opened, two metal pieces 11 adjacent to each other included in serially connected row 15 of metal pieces are conducted through two short-circuiting conductors 13 and grounding conductor 14. Therefore, direct current can flow between these metal pieces. The microwave, however, can hardly propagate between these metal pieces because metal piece 11 and short-circuiting conductor 13 have the above-mentioned dimensions.

Accordingly, electromagnetic field distribution adjustment device 5A constitutes an open plane that has substantially infinite impedance near the plurality of metal pieces 11. As shown in FIG. 6, if electromagnetic waves are reflected on the open plane, a standing wave whose antinode lies on the open plane, i.e., surfaces of the plurality of metal pieces 11 will be formed.

In this way, by changing the impedance, electromagnetic field distribution adjustment device 5A can interchange positions of a node and an antinode of the standing wave generated by reflecting on electromagnetic field distribution adjustment device 5A.

Figure 7:
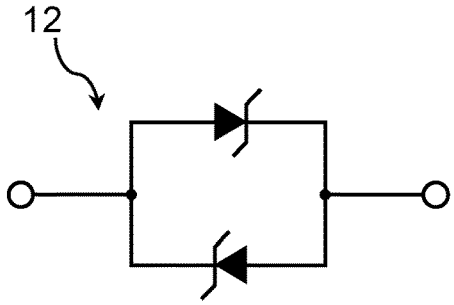
FIG. 7 is a view exemplarily showing a switch included in the electromagnetic field distribution adjustment device in accordance with the first exemplary embodiment.

FIG. 7 shows an example of switch 12 in accordance with the present exemplary embodiment. As shown in FIG. 7, two Zener diodes are parallelly connected in reverse directions from each other to constitute switch 12.

In the case where switch 12 is an element that has a breakdown voltage characteristic such as that of a Zener diode, if electromagnetic waves reach near switch 12, a potential difference larger than a predetermined threshold (breakdown voltage) will occurs between two metal pieces 11 connected to both ends of switch 12. At this time, switch 12 is changed from an open state to a closed state automatically.

Therefore, at a portion having a strong electromagnetic field in electromagnetic field distribution adjustment device 5A, the impedance changes into substantially zero automatically, so that a node of the standing wave occurs at the portion. Thus, the electromagnetic field at the portion is weakened automatically, thereby making it possible to prevent occurrence of uneven heating. Switch 12 may be a PIN diode or the like, for example.

As mentioned above, according to the present exemplary embodiment, the impedance of electromagnetic field distribution adjustment device 5A is set to be substantially zero or substantially infinite, thereby making it possible to interchange positions of a node and an antinode of the standing wave generated near electromagnetic field distribution adjustment device 5A, selectively. Thus, uneven heating can be reduced.

Figure 8:
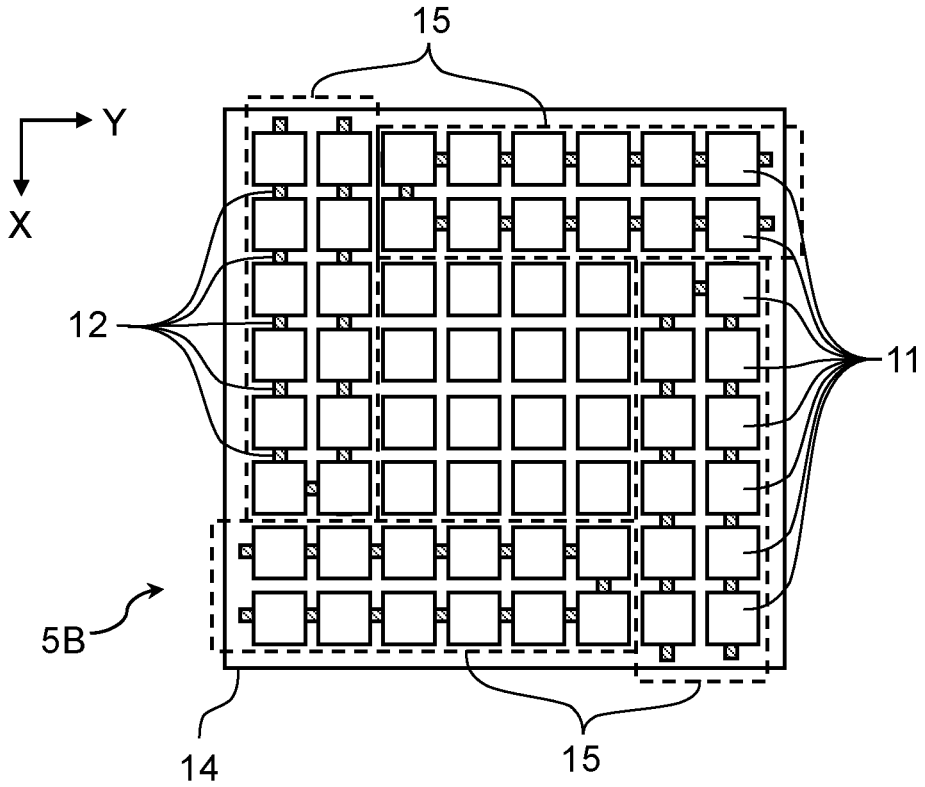
FIG. 8 is a top view of an electromagnetic field distribution adjustment device in accordance with a modification of the first exemplary embodiment.

FIG. 8 is a top view of electromagnetic field distribution adjustment device 5B in accordance with a modification of the present exemplary embodiment. As shown in FIG. 8, electromagnetic field distribution adjustment device 5B has four serially connected rows 15 of metal pieces. Each of four serially connected rows 15 of metal pieces has twelve metal pieces 11 that are connected in series with one another through eleven switches 12 to form a U-shape. On the other hand, sixteen metal pieces 11, which are provided near the center of electromagnetic field distribution adjustment device 5B, are not connected with one another through switches 12.

Typically, in processing where frozen food is thawed, it is hard to heat a center portion of object 6 to be heated, whereas the remaining portion thereof is comparatively easy to heat. According to the modification, since a center portion of electromagnetic field distribution adjustment device 5B, which is close to the center portion of object 6 to be heated, is caused to function as a magnetic wall constantly, an electromagnetic field can be formed so as to heat the center of object 6 to be heated intensively.

The shape of metal piece 11 is not limited to a square. Any shape other than a square may be employed as long as the plurality of metal pieces 11 are arranged to fill the predetermined two-dimensional region.

Grounding conductor 14 will not be limited to a plate-like shape as shown in FIG. 3, if metal piece 11 can be grounded. As an example, mesh-like grounding conductor 14 of which each opening does not pass electromagnetic waves may be employed.

Short-circuiting conductor 13 will not be limited to a column-like shape as shown in FIG. 4, if metal piece 11 can be grounded.

Metal piece 11 may be a conductive pattern provided on a dielectric substrate. In this case, metal piece 11 is supported by the dielectric substrate rather than short-circuiting conductor 13.

Second Exemplary Embodiment

Figure 9:
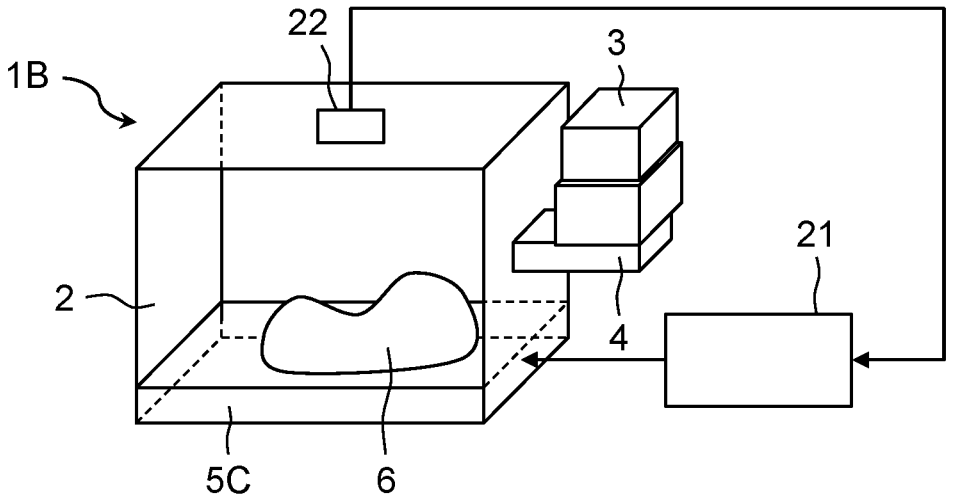
FIG. 9 is a perspective view of a microwave heating device including an electromagnetic field distribution adjustment device in accordance with a second exemplary embodiment of the present disclosure.

FIG. 9 is a perspective view of microwave heating device 1B in accordance with a second exemplary embodiment of the present disclosure. In FIG. 9, a front wall of heating chamber 2 is omitted such that the inside of heating chamber 2 can be seen.

As shown in FIG. 9, microwave heating device 1B includes electromagnetic field distribution adjustment device 5C whose impedance varies depending on a control signal from the outside. In the present exemplary embodiment, switch 12 is an element having a breakdown voltage characteristic such as that of a Zener diode, for example (see FIG. 7).

In addition to the configuration of microwave heating device 1A, microwave heating device 1B further includes controller 21 and temperature sensor 22. Controller 21 selects an operation mode of electromagnetic field distribution adjustment device 5C. Temperature sensor 22 detects temperature inside heating chamber 2.

Figure 10A:
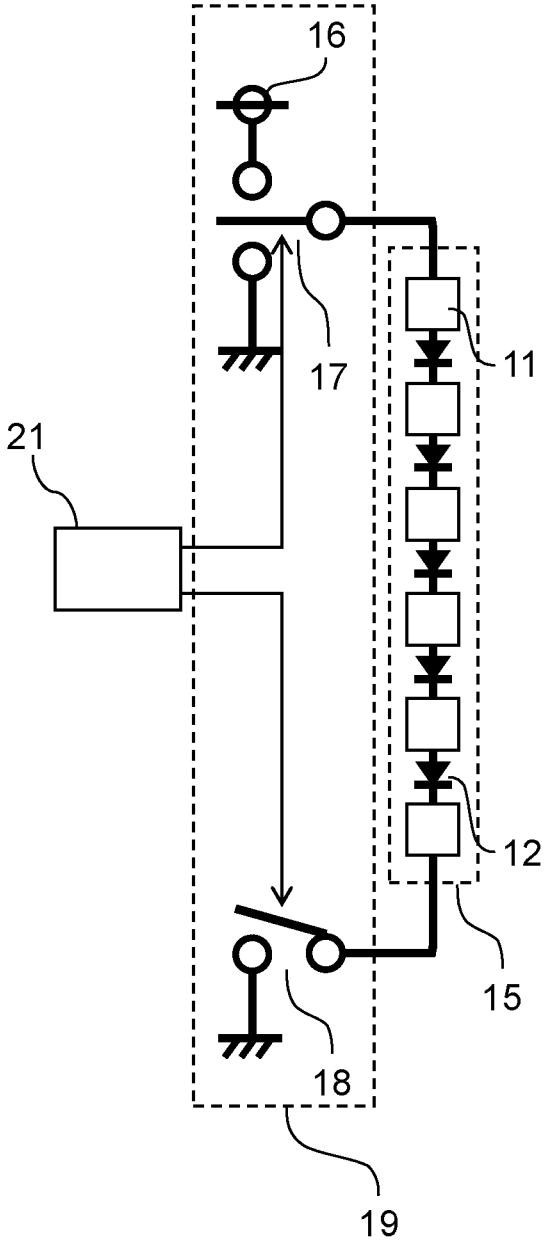
FIG. 10A is a block configuration diagram showing a concrete structure and an operation mode of the electromagnetic field distribution adjustment device in accordance with the second exemplary embodiment.
Figure 10B:
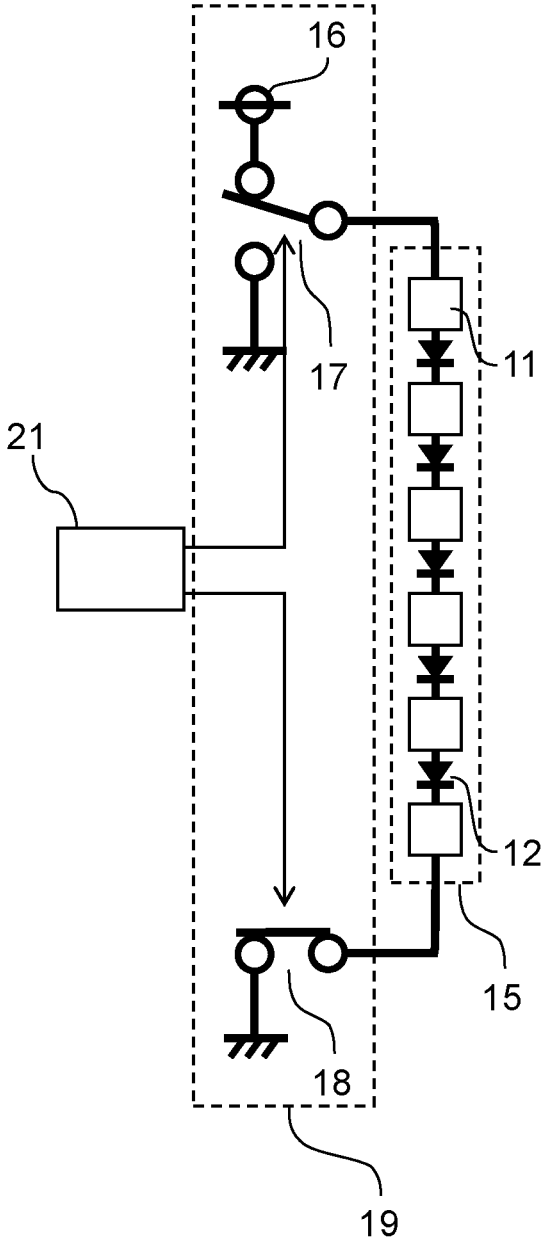
FIG. 10B is a block configuration diagram showing the concrete structure and an operation mode of the electromagnetic field distribution adjustment device in accordance with the second exemplary embodiment.
Figure 10C:
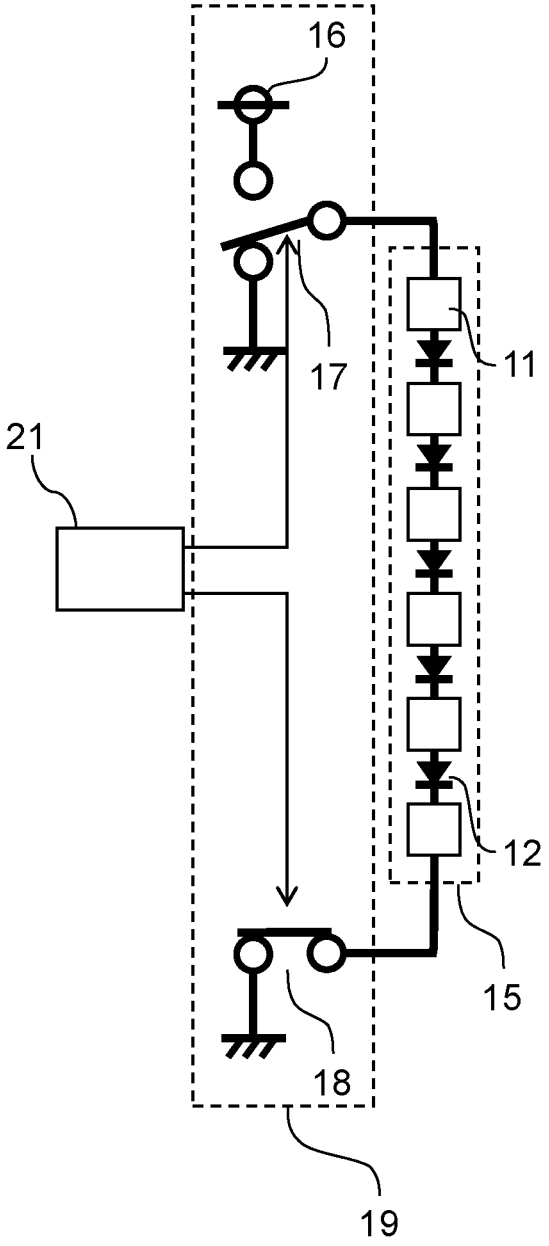
FIG. 10C is a block configuration diagram showing the concrete structure and an operation mode of the electromagnetic field distribution adjustment device in accordance with the second exemplary embodiment.

FIGS. 10A through 10C are block configuration diagrams each showing a concrete structure and an operation mode of electromagnetic field distribution adjustment device 5C. As shown in FIGS. 10A through 10C, electromagnetic field distribution adjustment device 5C has potential determination part 19 that includes selection switches 17 and 18 each being connected to serially connected row 15 of metal pieces. Selection switch 17 and selection switch 18 correspond to a first selection switch and a second selection switch, respectively.

Selection switch 17 selects whether metal piece 11 provided at one end of serially connected row 15 of metal pieces is connected to either direct-current voltage source 16 or ground, or neither of them. Selection switch 18 selects whether metal piece 11 provided at the other end of serially connected row 15 of metal pieces is connected to ground or not.

Hereinafter, metal piece 11 provided at one end of serially connected row 15 of metal pieces is referred to as one end of serially connected row 15 of metal pieces, and metal piece 11 provided at the other end of serially connected row 15 of metal pieces is referred to as the other end of serially connected row 15 of metal pieces.

Controller 21 controls selection switch 17 and selection switch 18, as follows, to select an operation mode of electromagnetic field distribution adjustment device 5C. In the present exemplary embodiment, a diode is used as switch 12, for example.

In FIG. 10A, the one end of serially connected row 15 of metal pieces is connected to neither direct-current voltage source 16 nor ground through selection switch 17. The other end of serially connected row 15 of metal pieces is not connected to ground through selection switch 18. In this case, serially connected row 15 of metal pieces is set in a self-controlled wall mode in which a state of switch 12 changes autonomously depending on an electric field generated on metal piece 11, so that the electric field is made uniform.

In FIG. 10B, the one end of serially connected row 15 of metal pieces is connected to direct-current voltage source 16 through selection switch 17. The other end of serially connected row 15 of metal pieces is connected to ground through selection switch 18. In this way, since metal piece 11 is forced to be short-circuited, serially connected row 15 of metal pieces is set in a successive conductor-plate mode in which one successive conductor plate is formed.

In FIG. 10C, the one end of serially connected row 15 of metal pieces is connected to ground through selection switch 17. The other end of serially connected row 15 of metal pieces is connected to ground through selection switch 18. In this way, since switch 12 is forced to be opened, serially connected row 15 of metal pieces is set in a magnetic wall mode in which serially connected row 15 of metal pieces functions as a magnetic wall.

Figure 11A:
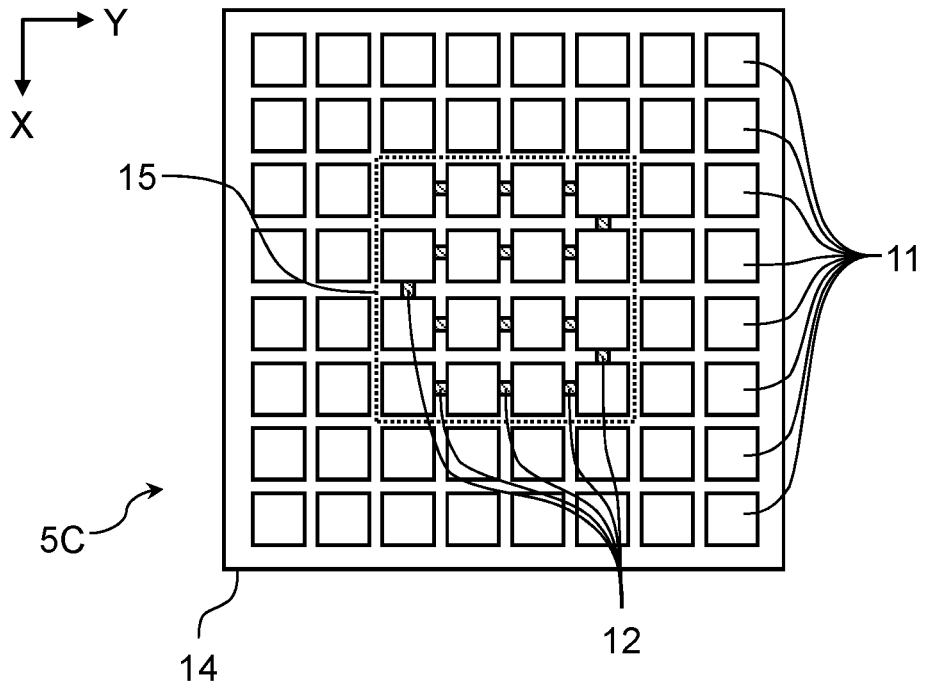
FIG. 11A is a top view of an electromagnetic field distribution adjustment device in accordance with a modification of the second exemplary embodiment.

FIG. 11A is a top view of electromagnetic field distribution adjustment device 5C in accordance with a modification of the present exemplary embodiment. As shown in FIG. 11A, the plurality of metal pieces 11 arranged to fill the predetermined two-dimensional region are not connected with one another through switches 12, except for sixteen metal pieces 11 placed in a center portion of electromagnetic field distribution adjustment device 5C.

Figure 11B:
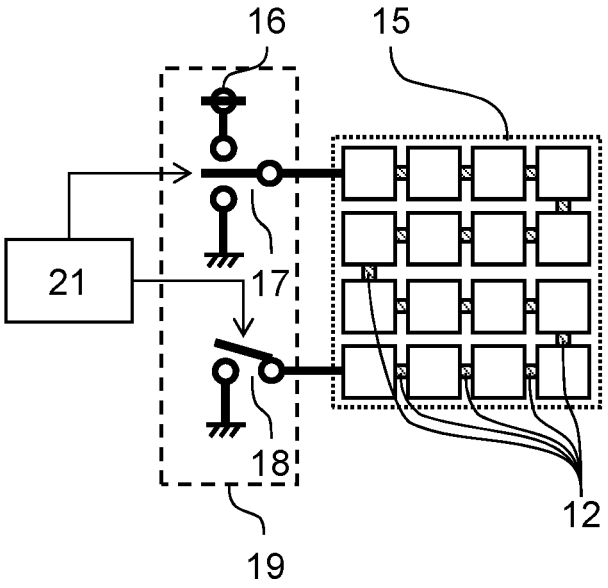
FIG. 11B is a block configuration diagram showing a concrete structure of the electromagnetic field distribution adjustment device in accordance with the modification of the second exemplary embodiment.

FIG. 11B is a block configuration diagram showing a concrete structure of electromagnetic field distribution adjustment device 5C, especially, serially connected row 15 of metal pieces. As shown in FIG. 11B, unlike serially connected rows 15 of metal pieces shown in FIGS. 10A through 10C, serially connected row 15 of metal pieces in accordance with the present modification is configured such that sixteen metal pieces, which are arranged in a square-like shape, are connected in series with one another through fifteen switches 12 to form a W-shape.

Hereinafter, thawing operation of the present exemplary embodiment will be described. The thawing operation is performed based on temperature detected by temperature sensor 22, with respect to object 6 to be heated, i.e., frozen food.

As heating progresses, object 6 to be heated changes from a low-dielectric state in which an entire surface area thereof is frozen to a high-dielectric state in which almost all surface area thereof is thawed, via a state in which the surface area thereof is partially thawed.

At the beginning of heating, controller 21 sets electromagnetic field distribution adjustment device 5C in the magnetic wall mode (see FIG. 10C), because object 6 to be heated, which is in a frozen state, should be heated as strongly as possible.

As heating progresses, when the temperature of object 6 to be heated approaches zero degrees, at least a part of the surface area of object 6 to be heated is thawed, thereby increasing a dielectric constant of the area. For this reason, if electromagnetic field distribution adjustment device 5C remains in the magnetic wall mode, heat will concentrate at the area.

Therefore, to achieve uniform thawing, controller 21 sets electromagnetic field distribution adjustment device 5C in the successive conductor-plate mode (see FIG. 10B).

When the temperature of object 6 to be heated exceeds zero degrees, an entire surface area of object 6 to be heated is thawed. Under this condition, controller 21 sets electromagnetic field distribution adjustment device 5C in the self-controlled wall mode (see FIG. 10A).

In this way, the operation modes of electromagnetic field distribution adjustment device 5C are changed based on the temperature of object 6 to be heated, thereby making it possible to heat frozen food appropriately.

In the first and second exemplary embodiments mentioned above, the electromagnetic field distribution adjustment device is provided over the entire bottom face of heating chamber 2. The present disclosure, however, is not limited to the above-mentioned exemplary embodiments.

Third Exemplary Embodiment

It is not necessary to provide the electromagnetic field distribution adjustment device in the entire bottom face of heating chamber 2.

Figure 12:
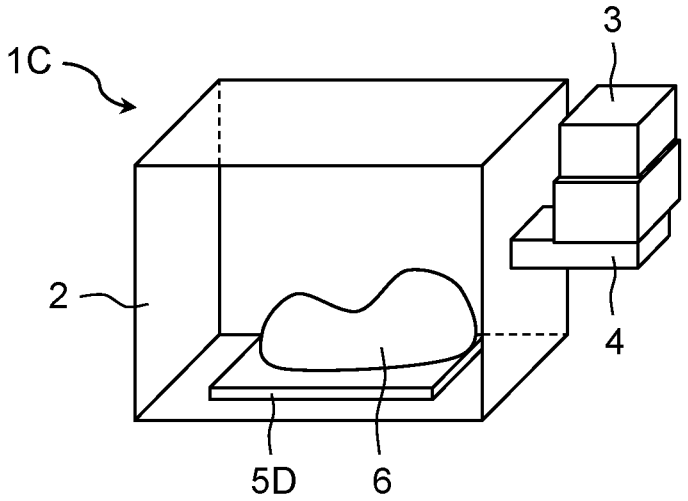
FIG. 12 is a perspective view of a microwave heating device in accordance with a third exemplary embodiment of the present disclosure.

FIG. 12 is a perspective view of microwave heating device 1C in accordance with a third exemplary embodiment. In FIG. 12, a front wall of heating chamber 2 is omitted such that the inside of heating chamber 2 can be seen.

As shown in FIG. 12, microwave heating device 1C includes electromagnetic field distribution adjustment device 5D. Electromagnetic field distribution adjustment device 5D is provided in a part of the bottom face of heating chamber 2, rather than the entire bottom face thereof.

Electromagnetic field distribution adjustment device 5D may be detachably provided in any of wall faces of heating chambers 2. Thus, electromagnetic field distribution adjustment device 5D can be moved to a desired wall face within heating chamber 2 such that the standing wave distribution is changed more variously.

Fourth Exemplary Embodiment

The electromagnetic field distribution adjustment device may be provided over a plurality of two-dimensional regions within heating chamber 2.

Figure 13:
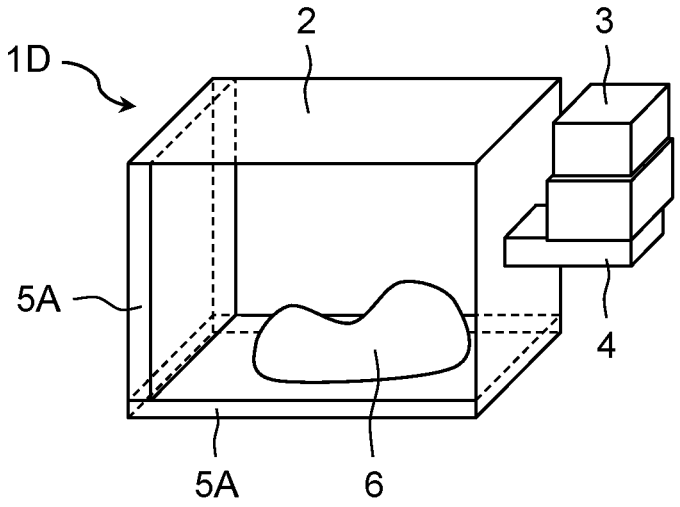
FIG. 13 is a perspective view of a microwave heating device in accordance with a fourth exemplary embodiment of the present disclosure.

FIG. 13 is a perspective view of microwave heating device 1D in accordance with a fourth exemplary embodiment. In FIG. 13, a front wall of heating chamber 2 is omitted such that the inside of heating chamber 2 can be seen.

As shown in FIG. 13, microwave heating device 1D includes two electromagnetic field distribution adjustment devices 5A provided in a bottom face and a side wall of heating chamber 2. According to the present exemplary embodiment, the standing wave distribution can be changed more variously.

Fifth Exemplary Embodiment

The electromagnetic field distribution adjustment device may be provided in other wall faces, such as a side wall and a ceiling of heating chamber 2, rather than the bottom face of heating chamber 2.

Figure 14:
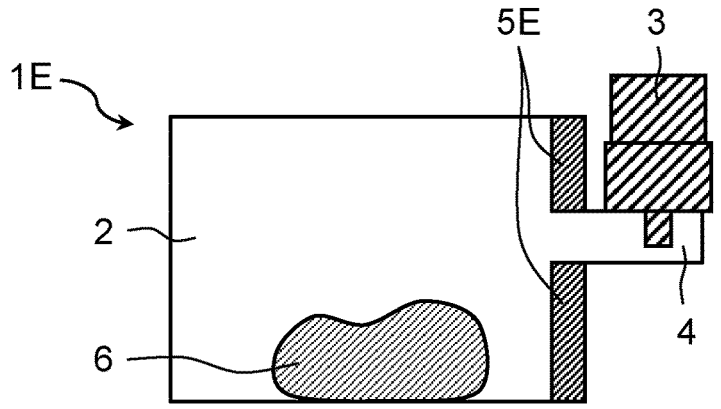
FIG. 14 is a perspective view of a microwave heating device in accordance with a fifth exemplary embodiment of the present disclosure.

FIG. 14 is a perspective view of microwave heating device 1E in accordance with a fifth exemplary embodiment. As shown in FIG. 14, microwave heating device 1E includes electromagnetic field distribution adjustment device 5E provided near an opening of wave guide tube 4. In the present exemplary embodiment, the opening of wave guide tube 4 is provided in a side wall of heating chamber 2.

Figure 15:
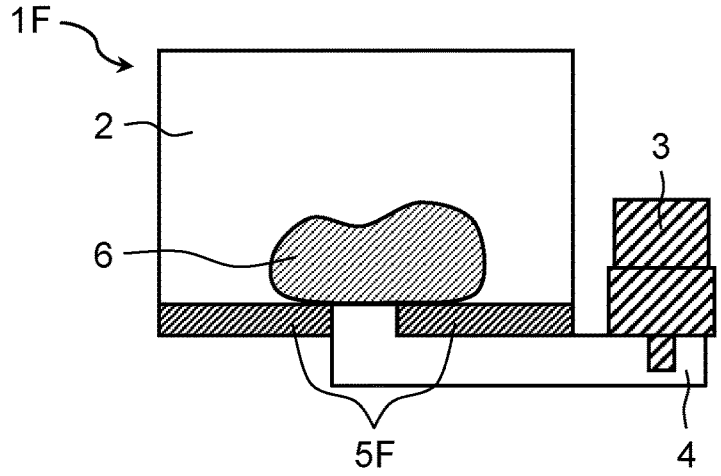
FIG. 15 is a perspective view of a microwave heating device in accordance with a first modification of the fifth exemplary embodiment.

FIG. 15 is a perspective view of microwave heating device 1F in accordance with a first modification of the present exemplary embodiment. As shown in FIG. 15, microwave heating device 1F includes electromagnetic field distribution adjustment device 5F provided near an opening of wave guide tube 4. In the present modification, the opening of wave guide tube 4 is provided in a bottom face of heating chamber 2.

Figure 16:
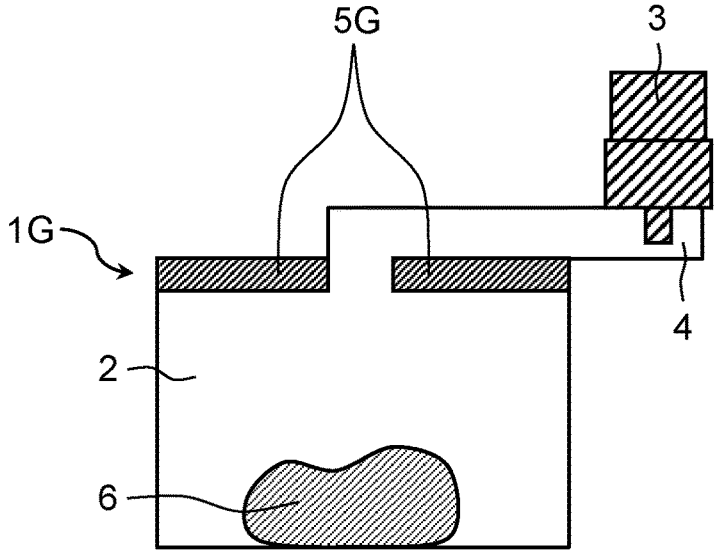
FIG. 16 is a perspective view of a microwave heating device in accordance with a second modification of the fifth exemplary embodiment.

FIG. 16 is a perspective view of microwave heating device 1G in accordance with a second modification of the present exemplary embodiment. As shown in FIG. 16, microwave heating device 1G includes electromagnetic field distribution adjustment device 5G provided near an opening of wave guide tube 4. In the present modification, the opening of wave guide tube 4 is provided in a ceiling of heating chamber 2.

According to the present exemplary embodiments including these modifications, the electromagnetic field distribution adjustment device is provided near the opening of wave guide tube 4, thereby making it possible to change the electromagnetic field distribution near the electromagnetic field distribution adjustment device satisfactorily.

INDUSTRIAL APPLICABILITY

The electromagnetic field distribution adjustment device in accordance with the present disclosure is applicable for not only a microwave oven but also other heating devices using dielectric heating, such as a garbage disposal.

REFERENCE MARKS IN THE DRAWINGS

1A, 1B, 1C, 1D, 1E, 1F, and 1G microwave heating device
2 heating chamber
3 microwave generator
4 wave guide tube
5A, 5B, 5C, 5D, 5E, 5F, and 5G electromagnetic field distribution adjustment device
6 object to be heated
11 metal piece
12 switch
13 short-circuiting conductor
14 grounding conductor
15 serially connected row of metal pieces
16 direct-current voltage source
17 and 18 selection switch
19 potential determination part
21 controller
22 temperature sensor

The invention claimed is:

1. An electromagnetic field distribution adjustment device comprising:

a plurality of metal pieces that are arranged to fill a predetermined two-dimensional region;

a plurality of switches that connect the plurality of metal pieces with one another; and a serially connected row of metal pieces that includes a portion configured by connecting one metal piece among the plurality of metal pieces to at most two metal pieces adjacent to the one metal piece through at least two of the plurality of switches, the at most two metal pieces being included in the metal pieces, wherein a first end of the serially connected row of metal pieces is connected to ground, to a direct-current voltage source, or left in an open state using a first selection switch, and a second end of the serially connected row of metal pieces is connected to ground or left in an open state using a second selection switch, the first selection switch and the second selection switch controlling different modes of operation of the electromagnetic field distribution adjustment device.

2. The electromagnetic field distribution adjustment device according to claim 1, wherein each of the plurality of metal pieces has one side whose length is less than half of wavelength of a microwave.

3. The electromagnetic field distribution adjustment device according to claim 1, further comprising:

a grounding conductor that is provided along the predetermined two-dimensional region; and a plurality of short-circuiting conductors that connect the plurality of metal pieces to the grounding conductor.

4. The electromagnetic field distribution adjustment device according to claim 1, wherein the electromagnetic field distribution adjustment device has substantially infinite impedance near the plurality of metal pieces when the plurality of switches are opened, and substantially zero impedance near the plurality of metal pieces when the plurality of switches are closed.

5. The electromagnetic field distribution adjustment device according to claim 1, wherein the serially connected row of metal pieces is disposed in a part of the predetermined two-dimensional region.

6. The electromagnetic field distribution adjustment device according to claim 1, further comprising a potential determination part that is configured to determine a potential of the serially connected row of metal pieces.

7. A microwave heating device comprising:

a heating chamber that accommodates an object to be heated;

a microwave generator that is configured to generate microwaves;

a wave guide tube that is configured to guide the microwaves to the heating chamber; and an electromagnetic field distribution adjustment device that is provided in a predetermined two-dimensional region within the heating chamber, the electromagnetic field distribution adjustment device including:

a plurality of metal pieces that are arranged to fill the predetermined two-dimensional region;

a plurality of switches that connect the plurality of metal pieces with one another; and a serially connected row of metal pieces that includes a portion configured by connecting one metal piece among the plurality of metal pieces to at most two metal pieces adjacent to the one metal piece through at least two of the plurality of switches, the at most two metal pieces being included in the metal pieces, wherein a first end of the serially connected row of metal pieces is connected to ground, to a direct-current voltage source, or left in an open state using a first selection switch, and a second end of the serially connected row of metal pieces is connected to ground or left in an open state using a second selection switch, the first selection switch and the second selection switch controlling different modes of operation of the electromagnetic field distribution adjustment device.

8. The microwave heating device according to claim 7, wherein the electromagnetic field distribution adjustment device is provided in at least one of wall faces within the heating chamber.

9. The microwave heating device according to claim 8, wherein the electromagnetic field distribution adjustment device is partially provided in the at least one of wall faces.

10. The microwave heating device according to claim 7, wherein the electromagnetic field distribution adjustment device is detachably provided in any of wall faces within the heating chamber.

11. The microwave heating device according to claim 7, wherein the electromagnetic field distribution adjustment device is provided near an opening of the wave guide tube.

* * * * *